United States Patent [19]

Jingu et al.

[11] Patent Number: 4,970,999

[45] Date of Patent: Nov. 20, 1990

[54] CYLINDER HEAD FOR OVERHEAD CAMSHAFT ENGINE

[75] Inventors: Nobuhisa Jingu, Yokohama; Yoshio Iwasa, Nagareyama, both of Japan

[73] Assignee: Nissan Motor Co., Ltd., Yokohama, Japan

[21] Appl. No.: 498,961

[22] Filed: Mar. 26, 1990

[30] Foreign Application Priority Data

Apr. 10, 1989 [JP] Japan ..... 1-88091

[51] Int. Cl.[5] ..... F02F 7/00

[52] U.S. Cl. ..... 123/195 C; 123/90.27

[58] Field of Search ..... 123/90.27, 90.31, 195 R, 123/195 C, 198 E

[56] References Cited

U.S. PATENT DOCUMENTS 1,568,615 1/1926 Parker ..... 123/90.31

4,750,455 6/1988 Ebesu ..... 123/90.27

FOREIGN PATENT DOCUMENTS 421359 12/1934 United Kingdom .

*Primary Examiner*—Noah P. Kamen

*Attorney, Agent, or Firm*—Foley & Lardner, Schwartz, Jeffery, Schwaab, Mack, Blumenthal & Evans

[57] ABSTRACT

A cylinder head for an overhead camshaft engine comprises an end wall to which an idler is rotatably mounted, and two side walls which extend in generally parallel from the end wall. Upper and lower beams interconnect and extend between the two side walls. The side walls, and the upper and lower beams cooperate with each other to define a mounting site extending to surround a window opening. A cover is detachably mounted on the mounting site to conceal the window opening.

5 Claims, 5 Drawing Sheets

CYLINDER HEAD FOR OVERHEAD CAMSHAFT ENGINE

BACKGROUND OF THE INVENTION

The present invention relates to an overhead camshaft engine which includes an idler for transmitting a driving force from a crankshaft to at least one camshaft.

JP No. 60-50208 A discloses a conventional arrangement around a cylinder head of a DOHC engine. This conventional arrangement is explained in connection with FIG. 5. Referring to FIG. 5, a pair of camshafts 52*a*, 52*b* are rotatably mounted to a cylinder head 51. A driving force of a crankshaft 53 is transmitted to the pair of camshafts 52*a*, 52*b* through a crank sprocket 54, a timing chain 55, an idler 56, a camshaft driving chain 57, and a pair of cam sprockets 58*a*, 58*b*.

The idler 56 is arranged to decrease rotation of the crankshaft 53, and includes a relatively large diameter gear 56*a* and a relatively small diameter gear 56*b*. Disposed in a space defined by an end wall 51*a* of the cylinder head 51 and an idler cover 59, the idler 56 is rotatably mounted to the end wall 51*a* by a bolt 60. With the bolt 60, the idler cover 59 is mounted to the end wall 51*a* through a shank 56*c*.

A problem encountered in such cylinder head arrangement is that, upon mounting the idler 56 to the end wall 51*a* of the cylinder head 51 by the bolt 60, the large and small diameter gears 56*a*, 56*b*, and the chains 55, 57 are difficult to properly index together by timing marks due to the presence of the idler cover 59.

Another problem is that, since the idler cover 59 is in contact with a cam cover 61 at the upper portion thereof and a timing chain cover 62 at the lower portion thereof, a vibration due to rotation of the idler 56 is transmitted to the cam cover 61 and the timing chain cover 62 through the idler cover 59, causing a noise.

SUMMARY OF THE INVENTION

An object of the present invention is to provide a cylinder head for an overhead camshaft engine wherein timing marks of an idler and those of timing and camshaft driving chains are easy to line up together, and a transmission of a noise due to rotation of the idler is effectively suppressed.

Specifically, one aspect of the present invention is to provide, in an internal combustion engine: a cylinder head having an end wall; an idler; means for rotatably supporting said idler, said idler supporting means being fixedly mounted to said cylinder head and extending from said end wall; means for partially surrounding said idler, and said idler supporting means, said partially surrounding means including two side walls extending in generally parallel from said end wall, said partially surrounding means having a window opening, said partially surrounding means including a first beam interconnecting and extending between said two side walls, said partially surrounding means including a second beam interconnecting and extending between said two side walls, said second beam being spaced from said first beam, said first beam, said second beam and said side walls cooperating with each other to define a mounting site extending to surround said window opening; a cover detachably mounted on said mounting site to conceal said window opening, whereby a transmission of noise emanated from said idler is suppressed by said partially surrounding means and said cover, and an adjustment in installation of said idler is made without any difficult via said window opening.

DETAILED DESCRIPTION OF THE INVENTION

Figure 1:
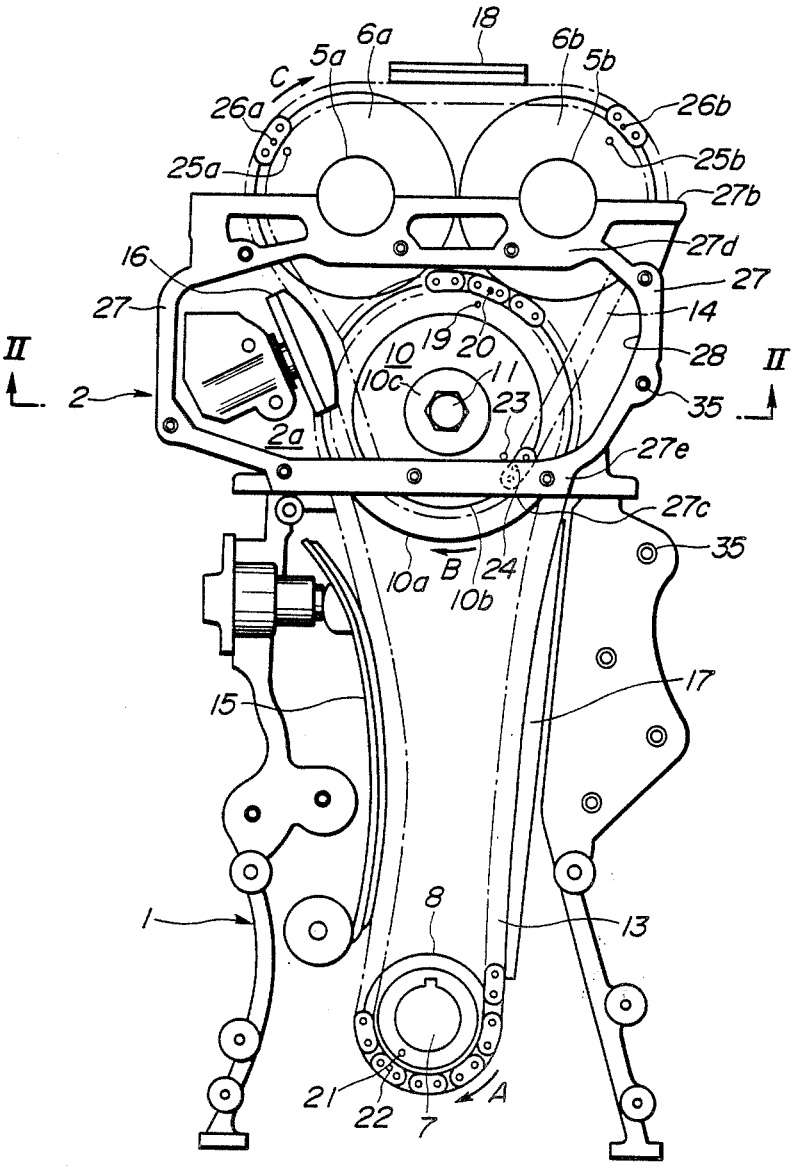
FIG. 1 is an axial end view illustrating an embodiment of an overhead camshaft engine according to the present invention.

Referring to the drawings, an embodiment of the present invention is described.

Referring first to FIG. 1, a cylinder head 2 is fixedly mounted to a cylinder block 1 by means of a gasket (not shown) and bolts (not shown).

Rotatably supported to the cylinder head 2 are an intake camshaft 5*a* for cyclically opening and closing intake valves 3 and an exhaust camshaft 5*b* for cyclically opening and closing exhaust valves 4. Two cam sprockets 6*a*, 6*b* are coupled with the camshafts 5*a*, 5*b*.

A crank sprocket 8 is coupled with a crankshaft 7 which is rotatably supported to the cylinder block 1.

Figure 2:
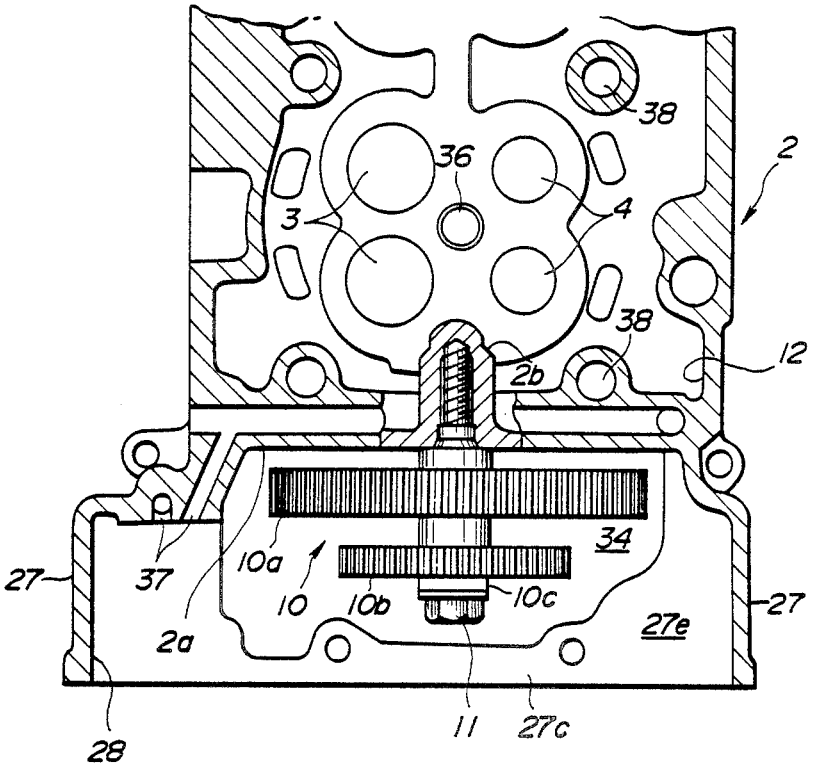
FIG. 2 is a transverse section taken through the line II—II of FIG. 1 with an idler installed.

Referring to FIG. 2, an idler 10 is formed with a relatively large diameter gear 10*a* and a relatively small diameter gear 10*b*. The idler 10 is rotatably mounted to an end wall 2*a* of the cylinder head 2 by an idler mounting bolt 11 which is inserted in an idler shank 10*c*. A boss 2*b* is formed at the reverse side of the end wall 2*a* to which the idler mounting bolt 11 is secured, and it faces an engine coolant passage 12.

As best seen in FIG. 1, a timing chain 13 drivingly interconnects the crank sprocket 8 and the large idler gear 10*a*, whereas a camshaft driving chain 14 drivingly interconnects the small diameter gear 10*b* and the cam sprockets 6*a*, 6*b*. There are provided two movable chain tensioners 15, 16, and two fixed chain tensioners 17, 18.

The diameter of the large diameter gear 10*a* is twice as large as that of the crank sprocket 8, so that the idler gear 10 rotates at a speed one half the rotational speed of the crankshaft 7. On the other hand, the diameter of the small diameter gear 10*b* is as large as that of the cam sprockets 6*a*, 6*b*, so that the camshafts 5*a*, 5*b* rotate at the same speed as the rotational speed of the idler gear 10.

The large diameter gear 10*a* has a timing mark 19. The mark 19 and a mark 20 of the timing chain 13 are lined up together. On the other hand, the crank sprocket 8 has a timing mark 21. The mark 21 and a mark 22 of the timing chain 13 are lined up together.

Further, the small diameter gear 10*b* has a timing mark 23. The mark 23 and a mark 24 of the camshaft driving chain 14 are lined up together. On the other hand, the cam sprockets 6*a*, 6*b* have timing marks 25*a*, 25*b*, respectively. The marks 25*a*, 25*b* and marks 26*a*, 26*b* of the camshaft driving chain 14 are lined up, respectively.

Figure 3:
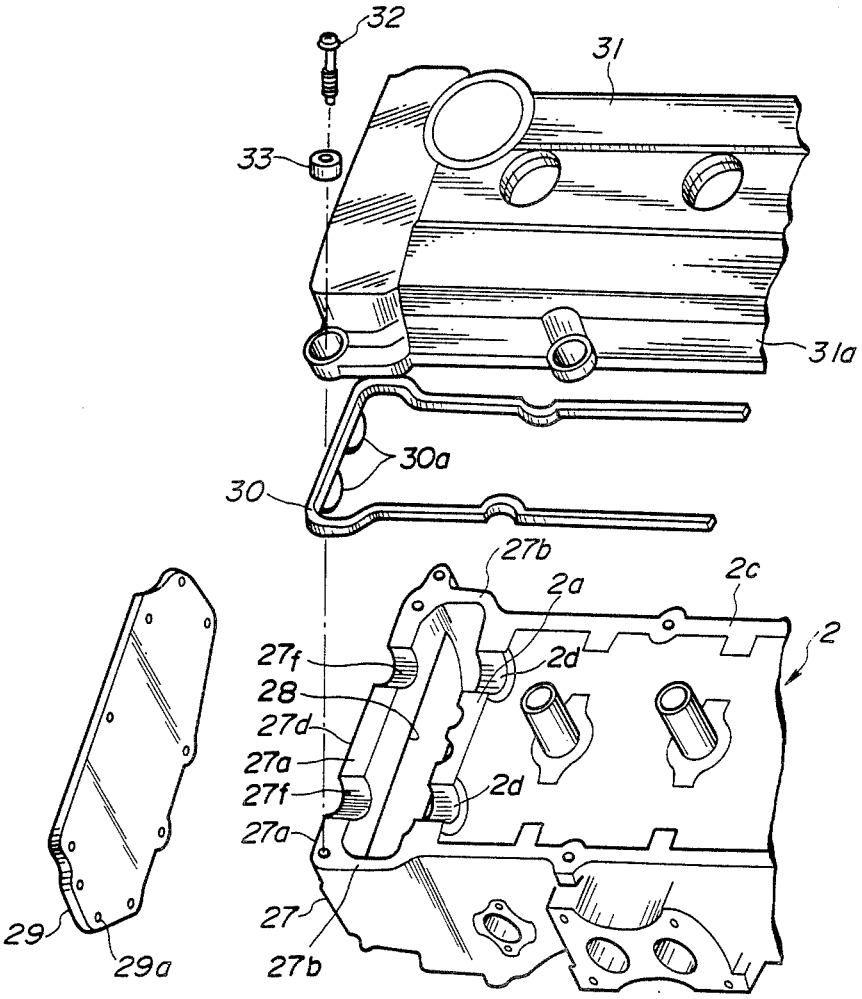
FIG. 3 is a fragmentary exploded perspective view illustrating a cam cover, a cylinder head, a gasket, and an idler cover.

As best seen in FIGS. 2 and 3, two side walls 27 are connected to and extend in generally parallel from the end wall 2*a* of the cylinder head 2. Upper and lower beams 27*d*, 27*e* interconnect the side walls 27. The upper beam 27d is formed with two concave portions 27f which are formed upon machining of two bearings 2d for the camshafts 5a, 5b. The beams 27d, 27e are spaced from each other, and contribute to an improvement in strength or rigidity of the side walls 27. The side walls 27, and the upper and lower beams 27d, 27e cooperate to define a mounting site surrounding a window opening 28 opposite to the idler 10. A width of the window opening 28 is larger than the diameter of the large diameter gear 10a. An idler cover 29 is mounted to the mounting site in a seal-tight manner. The idler cover 29 is formed with a plurality of bolt holes 29a.

Figure 4:
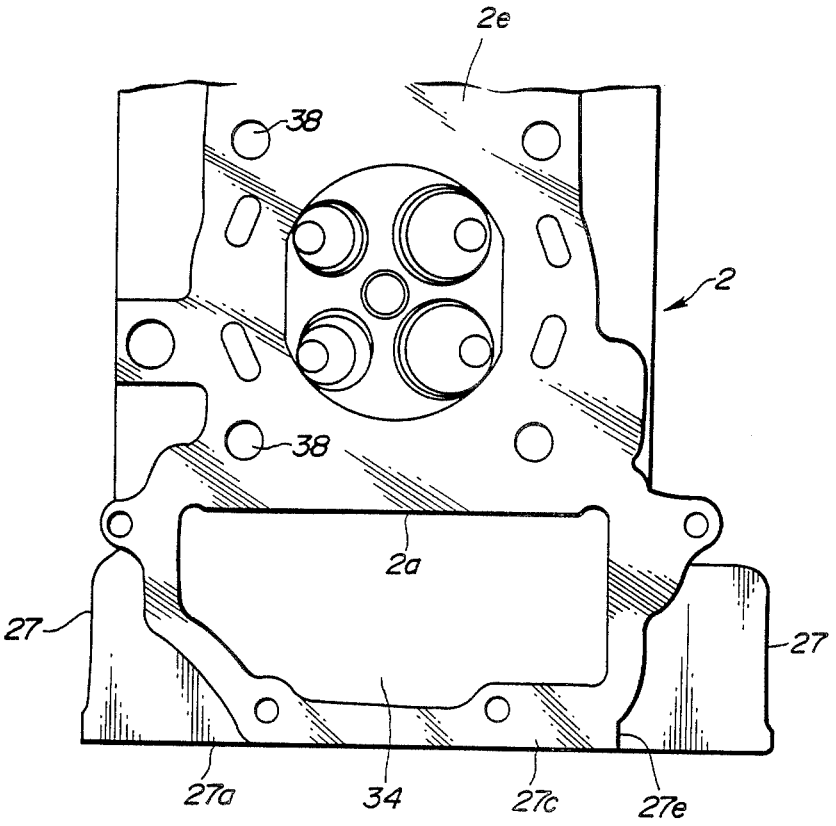
FIG. 4 is a bottom view of the cylinder head.
Figure 5:
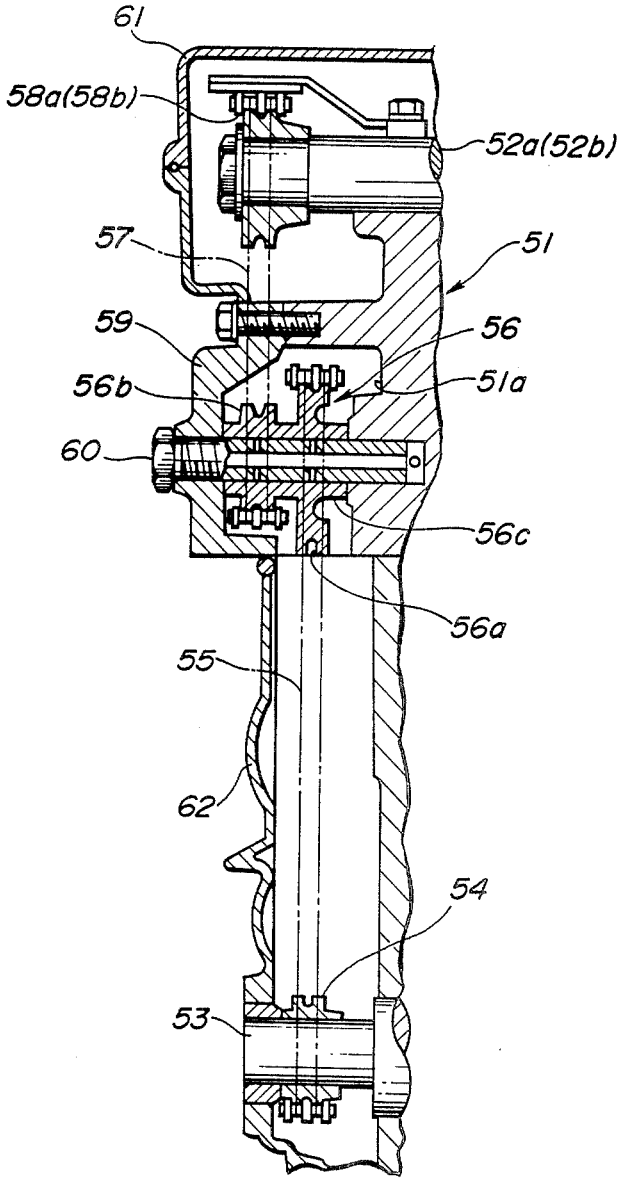
FIG. 5 (PRIOR ART)
FIG. 5 is a fragmentary vertical section illustrating a conventional DOHC engine.

As best seen in FIG. 4, a bottom wall 27c, viz., a third wall, which is formed with an opening 34 extends to connect the side walls 27, and the lower beam 27e. A width of the opening 34 is larger than the diameter of the large diameter gear 10a. A bottom 2e of the cylinder head 2, and the bottom wall 27c cooperate to form one flat bottom face. A timing chain cover, not shown, is adapted to contact with the bottom wall 27c through a seal member. The side walls 27, the upper and lower beams 27d, 27e, and the bottom wall 27c cooperate to partially surround the idler 10, the bolt 11, and the shank 10c.

As best seen in FIG. 3, upper end faces 2c, 27a, 27b of the cylinder head 2, the upper beam 27d, and the side walls 27 cooperate to form one flat end face. A peripheral wall 31a of a cam cover 31 having a flat lower end face is adapted to connect with the upper end faces 2c, 27a, 27b through a gasket 30. Two convex portions 30a of the gasket 30 are fitted in the corresponding concave portions 27f of the upper beam 27d in a seal-tight manner. Bolts 32 and elastic members 33 are provided to secure the cam cover 31.

A reference numeral 35 in FIG. 1 designates a bolt hole, 36 and 37 in FIG. 2 designate an ignition plug and an oil passage, respectively, and 38 in FIGS. 2 and 4 designates a bolt hole for securing the cylinder block 1 to the cylinder head 2.

With such a structure, during operation of an engine, the large diameter gear 10a rotates in a direction of an arrow B through the crank sprocket 8 and the timing chain 13 in accordance with rotation of the crankshaft 7 in a direction of an arrow A. The large diameter gear 10a rotates at a speed one half the rotational speed of the crankshaft 7. The small diameter gear 10b rotates with the large diameter gear 10a, and drives the cam sprockets 6a, 6b through the camshaft driving chain 14, thus rotating the intake and exhaust camshafts 5a, 5b at the same speed as the small diameter gear 10b in a direction of an arrow C.

As a result, the intake and exhaust camshafts 5a, 5b rotate at a speed one half the rotational speed of the crankshaft 7, thus cyclically opening and closing the intake and exhaust valves 3, 4 at a predetermined rotational position or a crank angle of the crankshaft 7.

Next, a procedure for installing the idler 10, etc. is described.

First, the timing mark 19 of the large diameter gear 10a and that 20 of the timing chain 13 are lined up together. The idler 10 is fixedly mounted on the upper portion of the cylinder block 1 with a predetermined tool. After inserting the idler 10 in a space defined by the side walls 27 and the bottom wall 27c through the opening 34, the cylinder head 2 is fixedly mounted to the cylinder block 1.

Next, the idler mounting bolt 11 is secured to the end wall 2a of the cylinder head 2 through the window opening 28. The timing mark 23 of the small diameter gear 10b and that 24 of the camshaft driving chain 14, and also the timing marks 25a, 25b of the cam sprockets 6a, 6b and those 26a, 26b of the camshaft driving chain 14 are lined up, respectively. Then, the cam sprockets 6a, 6b are coupled with the intake and exhaust camshafts 5a, 5b.

Since the width of the window opening 28 is larger than the outer diameter of the large diameter gear 10a, it is easy to carry out a mounting of the idler mounting bolt 11 and an indexing of the large and small diameter gears 10a, 10b and the chains 13, 14. As a result, a timing for opening and closing the intake and exhaust valves 3, 4 can accurately be set to a predetermined value in accordance with rotation of the crankshaft 7.

The side walls 27 are formed with the end wall 2a of the cylinder head 2, and axially extend over the end of the idler shank 10c, thus a contact face of the cylinder head 2 with the idler cover 29 is located outwardly of the large and small diameter gears 10a, 10b, so that, even if a lubricating oil stuck to the gears 10a, 10b is splashed by a centrifugal force induced by rotation of the gears 10a, 10b, the splashed oil may not dash against the contact face, preventing an oil leakage therefrom.

Since the idler mounting bolt 11 is secured to the end wall 2a of the cylinder head 2 through the window opening 28, and the bolt 11 is not used for mounting the idler cover 29 to conceal the window opening 28, it is possible to prevent the oil leakage from the bolt holes 29a of the cover 29.

Since the boss 2b is formed at the reverse side of the end wall 2a to which the idler mounting bolt 11 is secured, and it faces the engine coolant passage 12, the idler shank 10c can be cooled through the bolt 11, resulting in a reduced wear of the shank 10c.

The width of the opening 34 of the bottom wall 27c is larger than the diameter of the large diameter gear 10a, so that, the idler 10 with the timing chain 13 can be received in the space defined by the side walls 27 and the bottom wall 27c when the cylinder head 2 is secured to the cylinder block 1, resulting in a great reduction in time necessary for mounting the cylinder head 2.

Finally, since the upper end faces 2c, 27a, 27b of the cylinder head 2, the upper beam 27d, and the side walls 27b cooperate to form one flat end face, and the peripheral wall 31a of the cam cover 31 has a flat end face, the cylinder head 2 and the cam cover 31 are sealed with the single gasket 30 having a portion shaped in accordance with the upper end faces 27a, 27b.

What is claimed is:

1. In an internal combustion engine:

a cylinder head having an end wall;

an idler;

means for rotatably supporting said idler, said idler supporting means being fixedly mounted to said cylinder head and extending from said end wall;

means for partially surrounding said idler, and said idler supporting means, said partially surrounding means including two side walls extending generally parallel from said end wall, said partially surrounding means having a window opening, said partially surrounding means including a first beam interconnecting and extending between said two side walls, said partially surrounding means including a second beam interconnecting and extending between said two side walls, said second beam being spaced from said first beam, said first beam, said second beam and said side walls cooperating with each other to define a mounting site extending to surround said window opening;

a cover detachably mounted on said mounting site to conceal said window opening, whereby a transmission of noise emanated from said idler is suppressed by said partially surrounding means and said cover, and an adjustment in installation of said idler is made without any difficult via said window opening.

2. An internal combustion engine as claimed in claim 1, wherein said partially surrounding means include a third wall interconnecting said two side walls and said second beam, said third wall having a second opening which is large enough to allow insertion of said idler.

3. An internal combustion engine as claimed in claim 2, wherein said cylinder head includes a boss portion which said rotatably supporting means is secured to.

4. An internal combustion engine as claimed in claim 1, wherein first end faces of said cylinder head, said first beam, and said two side walls cooperate to form one flat end face.

5. An internal combustion engine as claimed in claim 1, wherein a face of said cylinder head, and second end faces of said second beam, and said two side walls cooperate to form one flat face.

* * * * *